United States Patent [19]

Dufrane et al.

[11] 3,962,587

[45] June 8, 1976

[54] SHIPPING CASK FOR SPENT NUCLEAR FUEL ASSEMBLIES

[75] Inventors: Kenneth H. Dufrane, Orchard Park, N.Y.; Jack D. Rollins, Rosewell, Ga.; Ralph E. Best, Aiken, S.C.; Victor J. Barnhart, Pittsburgh, Pa.; Clifford J. Anderson, Silver Spring, Md.; Thomas H. Cox, Damascus, Md.; Robert R. Riggs, Edgewood, Md.

[73] Assignee: Nuclear Fuel Services, Inc., Rockville, Md.

[22] Filed: June 25, 1974

[21] Appl. No.: 483,039

[52] U.S. Cl. ..... 250/506; 250/507;515;518

[51] Int. Cl.² ..... G21F 5/00

[58] Field of Search ..... 250/428, 432, 496, 506, 250/507, 515, 518

[56] References Cited

UNITED STATES PATENTS

| | | | |
|---|---|---|---|
| 3,732,423 | 5/1973 | Peterson | 250/506 |
| 3,732,427 | 5/1973 | Trudeau et al. | 250/507 |
| 3,751,669 | 8/1973 | Bush, Jr. | 250/506 |
| 3,780,306 | 12/1973 | Anderson et al. | 250/507 X |
| 3,845,315 | 10/1974 | Blum | 250/506 |

*Primary Examiner*—Archie R. Borchelt

*Attorney, Agent, or Firm*—Bacon & Thomas

[57] ABSTRACT

A cask has an inner rectangular enclosure of stainless steel fitting, with a slight clearance in the similarly shaped interior of a generally rectangular body of depleted uranium serving as a gamma ray shield. A cylindrical shell surrounds the generally rectangular gamma ray shield and copper partitions divide the annular space therebetween into a plurality of compartments for a neutron absorbing liquid. Flow paths between compartments are provided without removing copper from the partitions or interrupting any radial heat conduction path of any partition. Transverse partitions in certain of the compartments provide for holding the radial thickness of the liquid generally uniform throughout the circumference of the cask.

5 Claims, 5 Drawing Figures

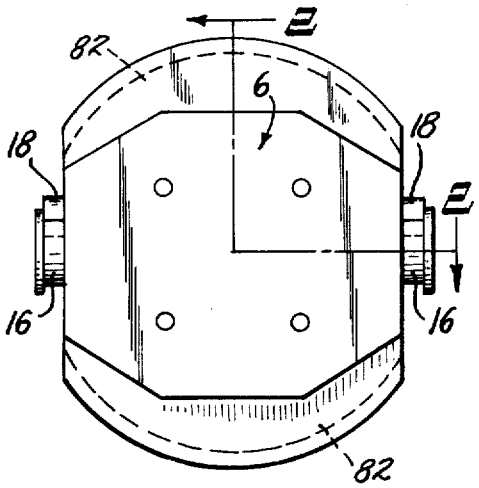
Fig. 1.
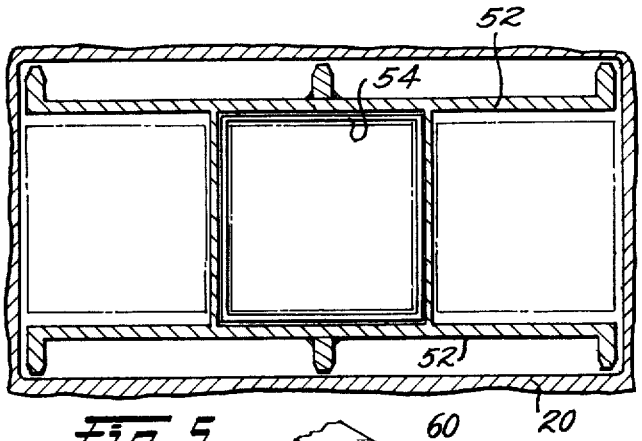
Fig. 5.
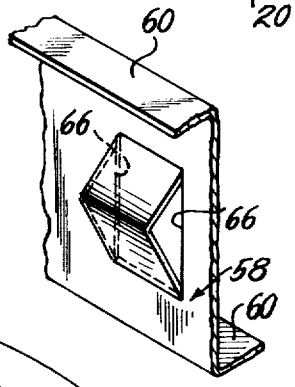
Fig. 4.
Fig. 3.
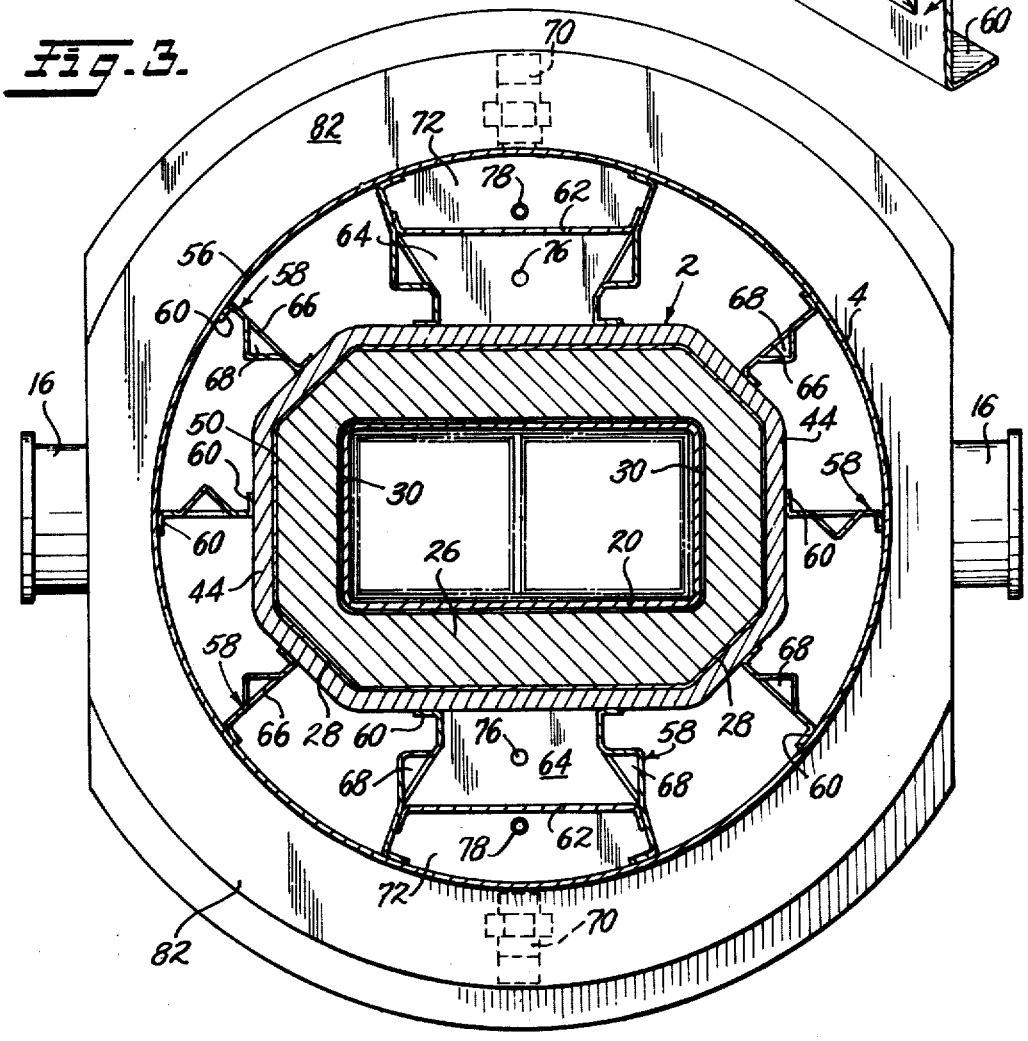

SHIPPING CASK FOR SPENT NUCLEAR FUEL ASSEMBLIES

BACKGROUND OF THE INVENTION

This invention is in the field of shipping containers, particularly for use in transporting spent nuclear fuel assemblies.

It is customary, in the operation of nuclear reactors, to remove the fuel assemblies after their energy has been depleted down to a predetermined level. Those fuel assemblies are customarily transported to a processor who reconcentrates the active fuel components and uses the concentrates to construct new fuel assemblies for use in such reactors. However, the so-called spent fuel is still highly radioactive and produces considerable heat and great care must be taken in its packaging and transportation to avoid overheating or the development of excessive pressure and/or other accidents including dangerous radiation to personnel. Heretofore, extremely bulky and heavy containers have been used and protection from possible external fires has been a difficult problem.

SUMMARY OF THE INVENTION

It is a principal object of this invention to provide a shipping cask for radioactive materials providing adequate protection against excessive radiation while efficiently dissipating internally generated heat, all by constructing the same in a manner to minimize expensive and difficult machining and assembly operations.

It is a further object of this invention to provide such a shipping cask adaptable to carry fuel assemblies of different sizes with a minimum of waste space.

Another object of the invention is to provide such a shipping cask meeting the previous objects and arranged to provide substantially uniform neutron absorption throughout its periphery.

Still another object of the invention is to provide such a shipping cask having heat conductive partitions therein providing for liquid flow through those partitions without removing heat conductive material therefrom and thus minimizing the amount of heat conductive material used.

BRIEF DESCRIPTION OF THE DRAWINGS

FIG. 1 is an end view of a cask embodying the present invention;

FIG. 3 is a transverse sectional view taken along the line 3—3 of FIG. 2 and showing two PWR fuel assemblies in the cask;

FIG. 4 is a fragmentary perspective view of a structural detail; and

FIG. 5 is a fragmentary sectional view showing three BWR fuel assemblies in the cask of FIG. 3.

DESCRIPTION OF A PREFERRED EMBODIMENT

Figure 2:
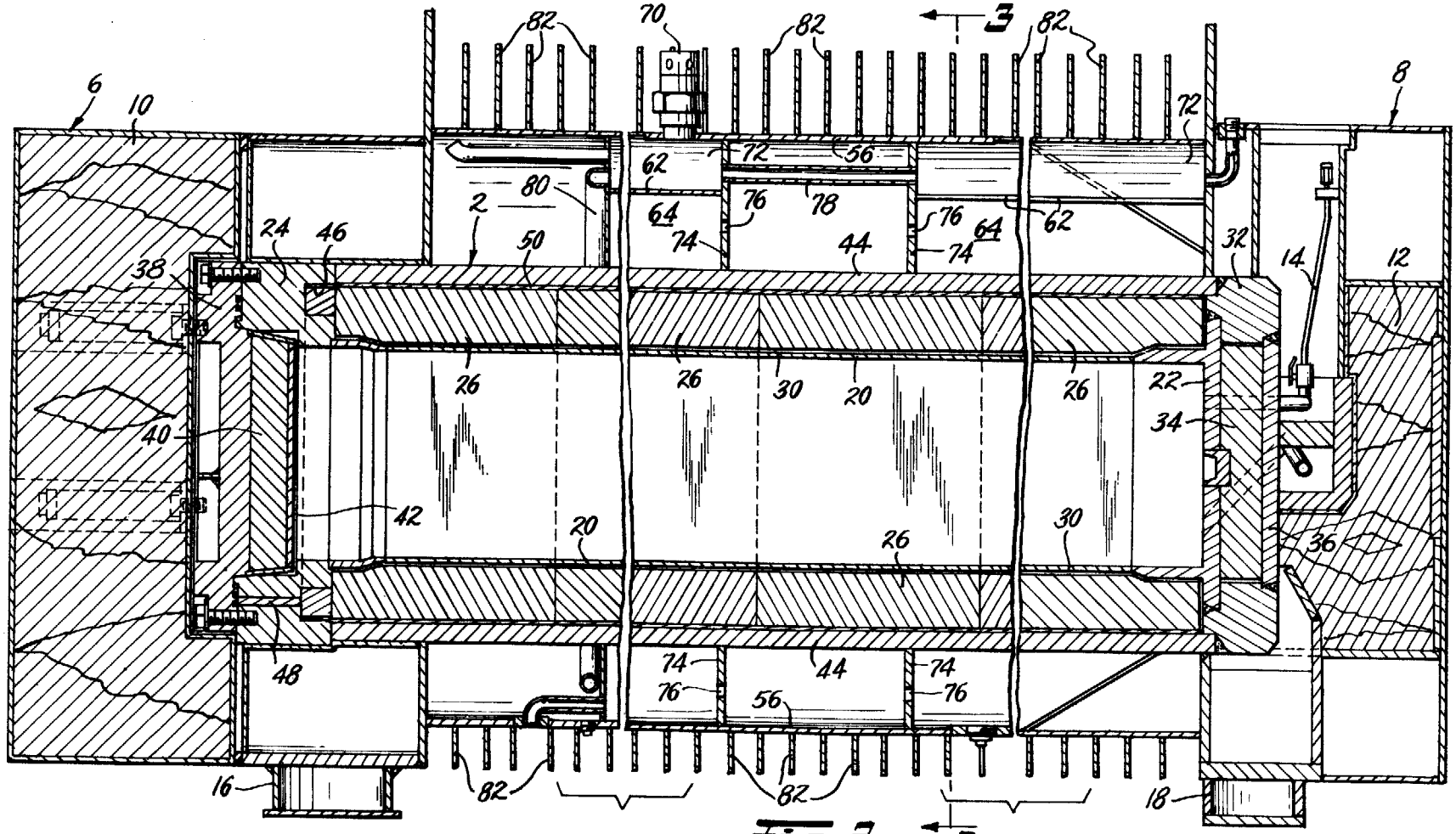
FIG. 2 is an enlarged longitudinal sectional view taken along the angled line 2—2 of FIG. 1.

The cask of the present invention is a modified version and in some respects an improvement on the spent fuel shipping cask shown and described in the copending application of Rollins et al, Ser. No. 336,191, filed Feb. 27, 1973.

The present invention resides in a modification of a shielding arrangement for a cask of the type shown in the copending application referred to. In general, the cask comprises means defining an inner enclosure structure 2 having compartments therearound for containing a neutron absorbing liquid confined by a shell 56. The cask also includes end structures 6 and 8 defining the ends of the cask and having balsa wood impact limiting means 10 and 12 and provided with suitable drain and other valves 14, all as generally described in the copending application.

The cask is further provided with trunnions 16 and 18, also of the type and relationship shown in the copending application.

According to the present invention the cask defines a rectangular inner container 20 of rectangular sectional shape. The container 20 is preferably of stainless steel and is welded at its bottom to a stainless steel closure 22 and at its upper end it is welded to a stainless steel flange ring 24. Surrounding the container 20 is a body of gamma ray shielding material comprising machined bodies 26 of depleted uranium. The use of depleted uranium as a gamma ray shielding material has been proposed heretofore but has not been widely used because of the difficulties in providing a sufficiently good fit with other elements to insure good heat transfer thereto. As shown in FIG. 3, the uranium members 26 are of generally annular shape but the central opening of each is rectangular, corresponding to the shape of the inner container 20. The outer circumference of each member 26 is also generally rectangular but the corners are cut off, as shown at 28 in FIG. 3. The members 26 are machined to the approximate size and shape desired but high precision in maintaining specified dimensions is not necessary. It would be extremely difficult to fabricate the inner container 20 and to machine the inner circumference of the members 26 to such exact dimensions that they would be in firm heat conducting contact throughout their peripheries. Furthermore, the technique of shrink fitting the members 26 onto the container 20 would be extremely expensive and would still require very accurate machining operations. As stated, the interior surfaces of the members 26 are machined slightly larger than the dimensions of the outer surface of container 20 so as to provide a slight clearance therebetween. That clearance is clearly shown in FIGS. 2 and 3 and is identified by reference numeral 30. Preferably, the normal spacing between the container 20 and the members 26 is of the order of 30 to 50 thousandths of an inch. This feature will be discussed further hereafter.

The members 26, which have been stated to be of generally annular shape, are placed in surrounding relation to the container 20 and with their axial end faces in abutment, as clearly shown in FIG. 2, thus providing a complete mantle of gamma ray shielding material around the periphery of the container 20. A further flange ring of stainless steel 32 is welded to the bottom closure 22 and a body of depleted uranium 34 is placed and held within the interior of the flange ring 32 by a cover plate 36, also of stainless steel, welded to the flange ring 32. Thus, gamma ray shielding is provided for the bottom of the desk.

A removable cover or closure 38 comprises a machined cover of stainless steel having a disc or body 40 of depleted uranium attached to the inner face thereof and held in place by a stainless steel shell 42 welded to the closure plate 38 and thus gamma ray shielding is provided at the top of the cask.

Surrounding the outer surface of the group of members 26 is a further stainless steel shell 44 which likewise is fabricated to provide a slight clearance between its inner surface and the outer surfaces of the members 26. However, it is essential that intimate heat conducting contact between the members 26 and the shell 44 be provided and it is further desired that the space between the container 20 and the members 26 be left free of any filler material. In fabricating the upper flange ring 24, the same is formed with an annular groove or channel 46 communicating with a passageway 48 (FIG. 2). In constructing the cask, after the flange ring 24 is welded to the container 20 and shell 44, molten lead is poured into the passageway 48 and is caused to fill the channel 46 and to flow into and fill the space between the shell 44 and bodies 26 to effect a bond therebetween and to provide intimate heat conducting contact throughout their adjacent surfaces. The lead between the bodies 26 and shell 44 is identified in FIG. 3 by numeral 50. It is contemplated that, during the pouring of the lead as described, it be prevented from flowing into the space 30 by cooling the upper peripheral portion of the container 20 to solidify any lead trying to enter that space a ıd to permit flow only into the space between shell 44 and members 26. It is also to be noted that the lead filling the channel 46 in flange ring 24 also serves as a gamma ray shield in the gap between the upper member 26 and the body 40 of depleted uranium in the cover plate.

The depleted uranium members 26, which are machined from uranium castings, provide most of the structural strength necessary to resist internal pressures and little reliance need be placed on the shells 20 or 44 for such strength. Obviously, casks employing lead as a gamma ray shield must rely on heavy and expensive stainless steel members for structural strength.

As is known, when even depleted fuel assemblies are housed in the container 20, they produce considerable heat which must be dissipated to prevent development of excessive pressures in the cask. It is customary to provide a coolant such as water in the container 20 and which water serves to remove heat from the fuel rods therein and provide a heat conductive path, by conduction and convection, to the walls of the container 20. Upon development of sufficiently high temperatures in the coolant water, the water expands and causes the walls of the container 20, which are somewhat flexible, to bulge outwardly into firm pressure contact with the inner surfaces of the members 26 and thus establish good heat conductive contact therebetween to transmit heat to the depleted uranium bodies 26 thence through the lead 50 and shell 44 to be dissipated to ambient air, as will be further described. Clearly, if the temperature within the container 20 drops sufficiently, the walls of the container will pull away from the bodies 26 until such time as the temperature has again reached a high enough value to bulge the walls 20 outwardly and thus the temperatures within container 20 are maintained at a safe value.

As shown in FIG. 3, the dimensions of the rectangular container 20 are such that it can receive and hold two PWR fuel assemblies as indicated in FIG. 3. It is further contemplated that a removable inner container be provided for one of the fuel assemblies that at least one of the fuel assemblies, if damaged, will be held without loss of fuel material therefrom. The removable container may be of the nature or type described in the copending application previously referred to wherein the fuel assembly is enclosed in a container having screened openings therein to permit free flow of coolant water into and out of the inner container while retaining any loose particles of fuel or other material therein.

FIG. 5 shows how the container 20 already described may be adapted to contain and transport three BWR fuel assemblies. In view of the standard dimensions of the two types of assemblies, it is necessary to provide an adapter arrangement, identified in FIG. 5 by numeral 52, to position the fuel assemblies and hold the same therein. The device 52 defines three compartments for receiving fuel assemblies while providing adequate space for coolant flow therearound. Here again, a foraminous inner container 54 provides for the containment of at least one failed fuel assembly without loss of material therefrom.

As best seen in FIG. 3, an outer cylindrical shell 56 is placed around and spaced from the shell 44 and is fixed relative thereto by a plurality of longitudinally extending copper partition members 58. The members 58 have flanges 60 at their inner and outer longitudinal edges, which flanges are suitably bonded and fixedly secured to the shells 44 and 56, respectively. The partitions 58 divide the annular space between shells 44 and 56 into a plurality of longitudinally extending compartments for holding a suitable liquid neutron absorbing material to absorb neutrons emitted by the depleted fuel assemblies. As will be apparent, the generally rectangular shape of the shell 44 results in a greater distance between shells 44 and 56 as shown at the top and bottom of FIG. 3, whereas the radial distance between those shells at the ends of the shell 44 is considerably less. Thus, sufficient neutron absorbing liquid to fill all of the compartments would result in an excess of such materials in the regions opposite the long sides of the shell 44, thus adding unnecessary material and considerable weight to the cask. To obviate the above-noted disadvantages longitudinal transverse partitions 62 are secured within the upper and lower compartments, as seen in FIG. 3, and are so positioned that the innermost compartments defined thereby and identified by numerals 64 are of generally the same radial dimension as the other compartments around the shell 44, thus providing substantially the same thickness of neutron absorbing material throughout the periphery of the cask.

Each of the copper partitions 58 is provided with one or more pairs of radial slits 66 (see FIG. 4), and at least the midportion of the material between each pair of slits is displaced laterally of the partition 58, as also shown in FIG. 4. This provides a multiplicity of openings 68 providing flow paths for liquid between adjacent compartments and thus neutron absorbing liquid may flow freely from compartment to compartment. It is to be noted, however, that no material is removed from the partitions 58 and the described displacement of the copper between the slits 66 still results in continuous heat conductive radial paths from the shell 44 to the shell 56 without interruption along the length of the partitions 58. Thus, maximum heat conduction is provided while permitting free liquid flow between compartments. When the compartments are filled with neutron absorbing liquid the liquid itself acts as a heat conducting medium in addition to the heat conduction provided by the partitions 58. However, in the event of an external fire, excessive pressure within the neutron absorbing shield will be relieved by rupture of one or more rupture disc valves, such as shown at 70, and the neutron absorbing liquid will be discharged, leaving the compartments between copper partitions 58 empty or nearly empty. Such empty spaces provide some thermal insulation from heat of an external fire while the partitions 58 provide for heat conduction outwardly from the fuel assemblies in addition to that radiated from the shell 44 outwardly to shell 56 across the empty compartments.

The transverse partitions 62 previously described divide the upper and lower compartments, as seen in FIG. 3, in the manner already described. Neutron absorbing liquid is provided only in the innermost of the pair of compartments thus divided and the outermost compartments 72 contain only air. As shown in FIG. 2, a plurality of transverse bulkheads or discs 74 provide mechanical strength to reinforce the outer shell 56 but those discs are provided with openings 76 through which liquid in compartments 64 can flow. The outermost compartments 72 are joined by a tube or pipe 78 to provide fluid communication between the end portions thereof and a suitable channel or conduit means 80 provides communication between the upper compartment 72 and the lower compartment 72, as seen in FIG. 3, such conduit being shown in FIG. 2. The empty compartment 72 constitutes a surge tank or pressure relief tank, related to the compartments containing the neutron absorbing material in essentially the same manner as fully described in pending application Ser. No. 336,191. Those features will not be further described herein.

It is further contemplated that the outer shell 56 be further provided with a multiplicity of radial fins 82 to dissipate heat to the ambient atmosphere. Such fins, however, are well known in the art and will not be further described herein.

From the foregoing description it will be apparent that applicants have achieved the objects of the invention in providing a cask relatively easy to fabricate, not requiring precision machining operations and yet achieving efficient heat transfer from the contained fuel assemblies to ambient air and providing adequate and uniform gamma ray and neutron shielding.

While a single specific embodiment has been shown and described, the same is merely illustrative of the principles involved and other embodiments may be constructed within the scope of the appended claims.

We claim:

1. A shipping cask for spent nuclear fuel assemblies, comprising:

an elongated, generally rectangular enclosure of somewhat flexible substantially flat stainless steel walls, gamma ray shielding said enclosure and comprising a plurality of depleted uranium bodies of generally annular shape encompassing said enclosure, abutting each other, and having flat surfaces adjacent but slightly spaced from the flat walls of said enclosure by a distance of the order of 30 to 50 thousandths of an inch whereby internal pressure in said enclosure will flex said flat walls outwardly into intimate heat-conducting contact with said flat surfaces;

a stainless steel shell enclosing said gamma ray shielding and being bonded to the outer surface thereof by heat conducting material.

2. A cask as defined in claim 1 wherein said heat conducting material is lead.

3. A shipping cask for spent nuclear fuel assemblies, comprising:

means defining an elongated inner enclosure including gamma ray shielding material and having an outer surface of generally rectangular sectional shape;

a generally cylindrical shell surrounding and spaced from said enclosure;

a plurality of longitudinal extending heat conductive partitions spanning the space between said enclosure and shell and defining therewith a plurality of compartments for liquid neutron absorbing material completely encompassing said inner enclosure, certain of said compartments being of greater radial dimension than others; and further partitions extending longitudinally in said certain compartments and dividing the same into radially inner chambers for neutron absorbing liquid and outer chambers, the radial dimensions of the inner chambers being of the same order of magnitude as the radial dimensions of the other compartments whereby to maintain substantially the same thickness of neutron absorbing liquid throughout the periphery of said cask.

4. A shipping cask as defined in claim 3 wherein said outer chambers communicate with said inner chambers and comprise expansion tanks for said liquid.

5. A shipping cask for spent nuclear fuel assemblies, comprising:

means defining an elongated inner enclosure including gamma ray shielding material and having an outer surface of generally rectangular sectional shape;

a generally cylindrical shell surrounding and spaced from said enclosure;

a plurality of longitudinally extending radial heat conductive partitions spanning the space between said enclosure and shell and defining therewith a plurality of compartments for liquid neutron absorbing material, said partitions being secured to said inner enclosure and said outer shell in heat conducting contact therewith, said partitons having pairs of radial slits therethrough and at least the midportion of the material between the slits of each pair being displaced laterally of its partition to provide liquid flow paths between said compartments while providing for uninterrupted radial conduction of heat throughout the length of each partition.

* * * * *